United States Patent [19]

Gibel et al.

[11] Patent Number: 4,848,520

[45] Date of Patent: Jul. 18, 1989

[54] TELESCOPIC MAST ASSEMBLY

[75] Inventors: John P. Gibel, Waterloo; Henry J Spies, London; Woldemar R. Petri, Cambridge, all of Canada

[73] Assignee: Carelift Equipment Limited, Breslau, Canada

[21] Appl. No.: 134,827

[22] Filed: Dec. 18, 1987

[30] Foreign Application Priority Data

Dec. 22, 1986 [GB] United Kingdom ..... 8630597

[51] Int. Cl.[4] ..... B66B 9/20

[52] U.S. Cl. ..... 187/9 E; 414/629

[58] Field of Search ..... 187/9 E, 9 R, 95; 212/183, 184, 267, 268; 52/123.1; 182/141; 414/630, 628, 629

[56] References Cited

U.S. PATENT DOCUMENTS 2,581,791 1/1952 Gilman ..... 187/9 E 3,709,393 1/1973 McGehee ..... 187/9 E 3,715,014 2/1973 Ohta ..... 187/9 E

*Primary Examiner*—Joseph J. Rolla

*Assistant Examiner*—Kenneth Noland

*Attorney, Agent, or Firm*—Anthony Asquith & Co.

[57] ABSTRACT

A telescopic mast for a fork lift truck is disclosed. The telescoping sections of the mast are arranged with the innermost section as the base section, which remains attached to the frame of the truck. The telescoping hydraulic tubes or cylinders are arranged so that the innermost tube is associated with the outermost mast-section. This outside-to-inside arrangement makes it possible for the mast sections to be provided with cross-braces and rails, and still to be telescope-able. The resulting mast-sections are very rigid and stable, yet are light in weight. As the sections are raised, the area exposed to hydraulic pressure becomes progressively less, with the result that the height to which a load can be raised is automatically limited.

8 Claims, 5 Drawing Sheets

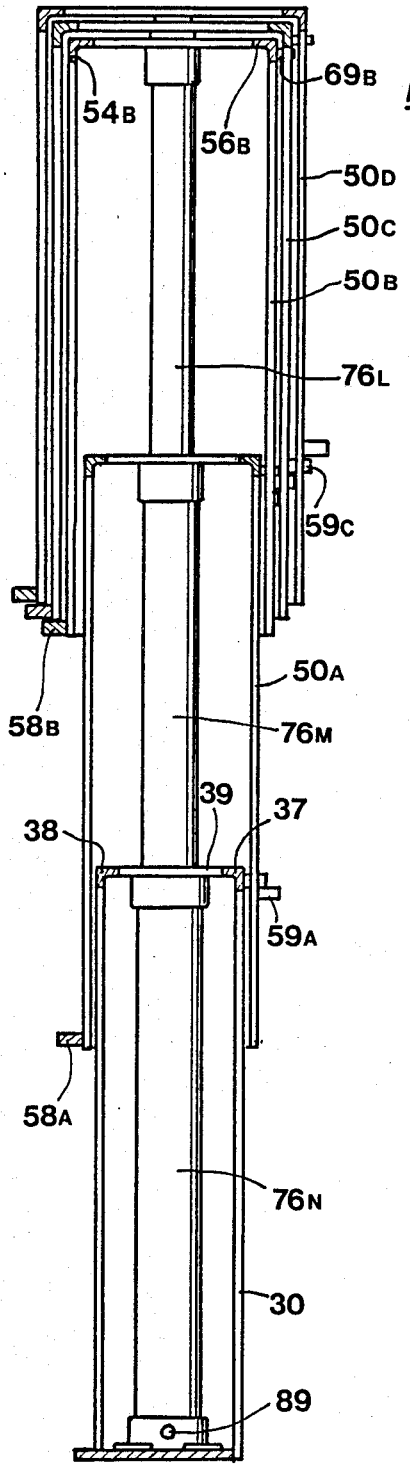
FIG2A
FIG2
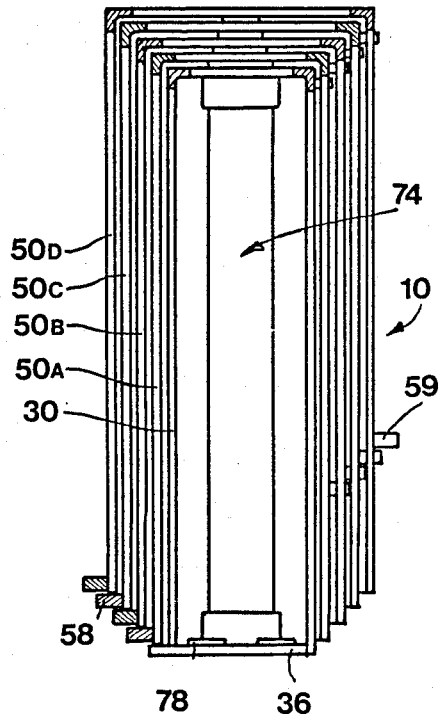

TELESCOPIC MAST ASSEMBLY

This invention relates to a telescoping mast assembly. A typical area of use of such a mast assembly is in a fork lift truck.

One of the basic problems of mast design, for fork lift trucks and many other mast applications, lies in making the mast stable and rigid when the mast is extended to its full height, yet at the same time in making the sections of the mast economical as to cost, and light in weight.

GENERAL DESCRIPTION OF THE INVENTION

In the invention, the telescopic mast of the forklift truck is raised by a telescopic hydraulic cylinder assembly. The hydraulic cylinder assembly comprises a series of tubes, each tube having a different diameter. The tubes are arranged one inside the other, for telescopic extension. Each tube has a respective travel-stop, relative to the adjacent tubes.

The tubes are sealed to each other hydraulically. The outermost tube is sealed at one of its end faces to create a hydraulic chamber within the outermost tube. The pressure-facing areas of all the tubes are all open to this chamber, and hence are all exposed to hydraulic pressure supplied to the chamber. A pump is provided, for supplying hydraulic fluid under pressure.

The hydraulic pump on a fork lift truck is generally of the positive-displacement kind. This kind of pump supplies fluid at a constant volumetric rate, which does not vary even when the pressure of the fluid varies. The hydraulic system on a truck also generally includes a pressure-relief valve. The pressure-relief valve is set to a predetermined value, such that if the pressure in the hydraulic circuit exceeds that value, the valve opens. The typical arrangement is that when the pressure-relief valve opens, the fluid output from the pump flows directly back to the fluid reservoir, and does not enter the hydraulic circuit. The fluid in a truck's hydraulic circuit remains at the predetermined pressure, once that pressure has been attained, until relieved by some action which will reduce the pressure, such as the removal of the load or the opening of another valve in the circuit.

In the invention, and when the hydraulic system includes the usual pump and pressure-relief valve, the fluid under pressure is supplied to the said hydraulic chamber, and the pressure acts on the pressure-facing ends of all the tubes. In the invention, all the tubes therefore (apart from the outermost tube which forms the chamber) at first rise in unison. When the next-to-outermost tube reaches its travel limit-stop, the next-to-outermost tube can extend no further with respect to the outermost tube, but the rest of the tubes, apart from the next-to-outermost tube, continue to rise in unison with each other. This procedure continues, the tubes being stopped progressively from the outermost tube inwards, until the innermost tube reaches its stop.

Thus, in the invention, all the tubes that have not yet reached their travel-stops move in unison as the telescopic cylinder extends—and the last tube to engage its travel-stop is the innermost-tube.

With the above-described usual kind of hydraulic supply, where the fluid is supplied at a constant volumetric rate up to a predetermined pressure, the load that can be raised is different for each tube. The load is determined, for a given hydraulic pressure, by the aggregate of pressure-facing areas of all the still-movable tubes. Thus, if all the tubes are still movable, ie when the mast has just started to extend, and is still at the bottom of its travel, the load that can be raised is set by the pressure facing area of all the tubes added together. On the other hand, when only the innermost tube is movable, ie when the mast is almost at the top of its extension, all the other tubes having reached their respective travel limit-stops, the magnitude of the load that can be raised is set by the area of the innermost tube alone.

The arrangement of the invention therefore provides an automatic way of ensuring that a load cannot be lifted above its safe height. When the load is light enough that the load can be raised by the predetermined pressure acting on the area of the innermost-tube alone, then the load can be raised to the full extension of the mast. But if the load is heavy, such that the combined areas of a number of the tubes are necessary to raise the load, then the mast will not extend any further once that number of tubes have reached their limit-stops.

It will be noted that, in the invention, the driver of the vehicle takes no action to set the varying height limit. Once the predetermined value has been set into the pressure-relief valve, the height to which a particular load can be raised is automatically set also.

In a fork lift truck, the tubes of the telescopic hydraulic assembly are arranged to extend the telescopically-extendable sections of the mast itself. In a preferred arrangement of the invention, each tube is associated with a respective mast section. The preferred arrangement is that the innermost tube is associated with the outermost mast-section; the next-to-innermost tube with the next-to-outermost section; and so on. The effect of this arrangement is that each tube can at all stages of mast extension be in actual contact with its associated mast section.

It is recognised in the invention that when the tube can actually touch, and be fixed to, the mast-section, the strength and rigidity of each can complement the other. The result is a very efficient structure of mast, from the point of view of the ratio of rigidity-to-mass.

It is also recognised in the invention that this outside-to-inside arrangement can be applied to masts in general, not just to the masts of fork lift trucks. The preferred arrangement of the invention means that the individual sections of the mast can be engaged directly with the associated individual hydraulic tubes; this feature gives worthwhile improvements in the rigidity-to-mass ratio of telescopic masts in general, such as the masts of cranes, extendable booms, and so on.

A fork lift truck mast is different from other masts mainly as regards its manner of use. In, say a telescopic crane mast, the mast is extended to its full height just once, and remains at the full extension during operation; and the crane does not start to lift loads until the mast is set in position. In a fork lift truck, the mast is constantly extending and descending under load. The fork lift truck usage is therefore more demanding, in that while the crane mast only needs to have full strength and rigidity when the mast is fully extended and erect, a fork lift truck mast needs to have rigidity at all stages of extension. The preferred arrangement mentioned above, which has been termed the outside-to-inside arrangement of the tubes and mast-sections, therefore is particularly useful with fork lift truck masts, since the arrangement allows the sections and tubes to assist each other at all heights of the mast.

As will be seen from the description of a particular embodiment of the invention, which follows, the outside-to-inside arrangement of the mast sections and tubes can be arranged so that the outermost mast-section is the last section to engage its travel-stop, ie the section that rises the furthest, and also (consequently) that the innermost tube is the tube that rises the furthest. It will be seen that this arrangement of the mast-sections allows the mast-sections to be adequately rigid by virtue of shape, rather than by virtue of the use of massive thicknesses of material.

DETAILED DESCRIPTION OF PREFERRED EMBODIMENT OF THE INVENTION

The invention will now be further described by referring to a particular example of the manner in which the invention may be put into practice.

In the drawings:

FIG. 2 is a longitudinal cross-section of the mast assembly, shown out of proportion to illustrate the detail;

Figure 1:
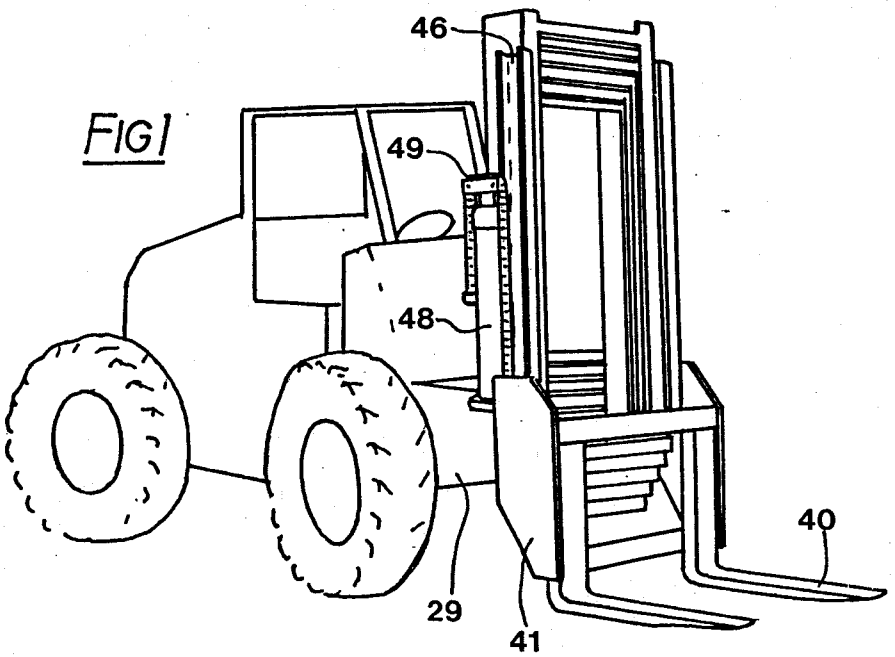
FIG. 1 is a pictorial view of a fork lift truck having a mast assembly which embodies the invention.
Figure 3:
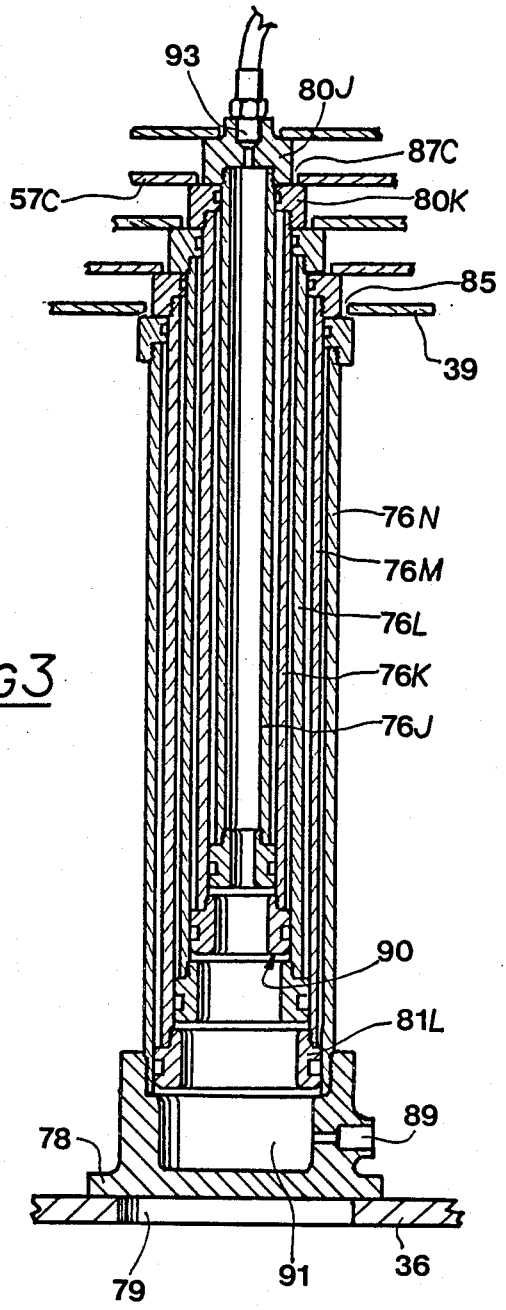
Figure 6:
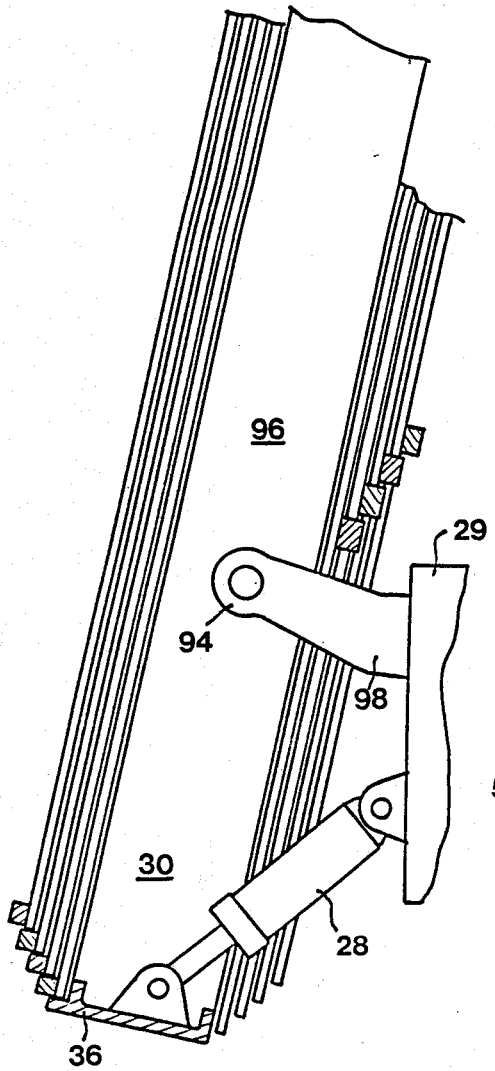
Figure 4:
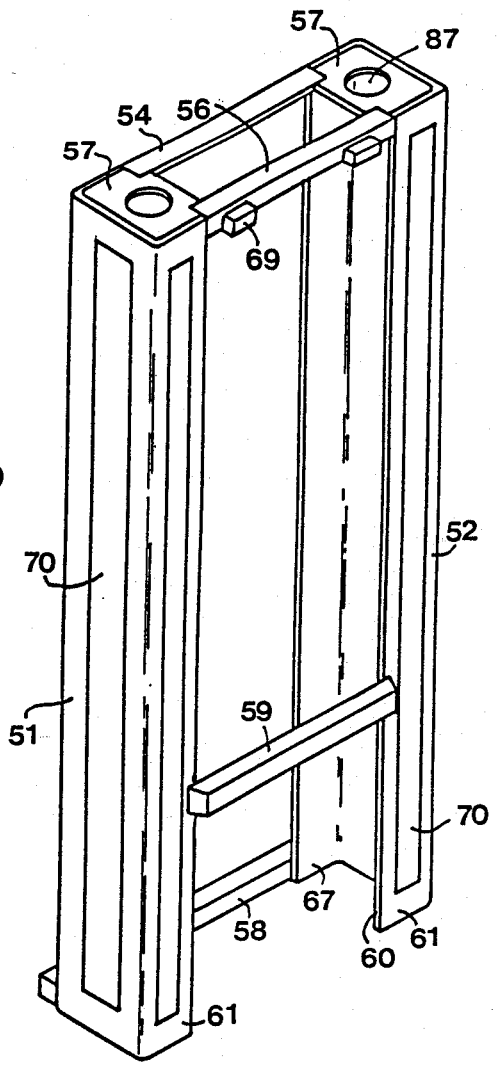
Figure 5:
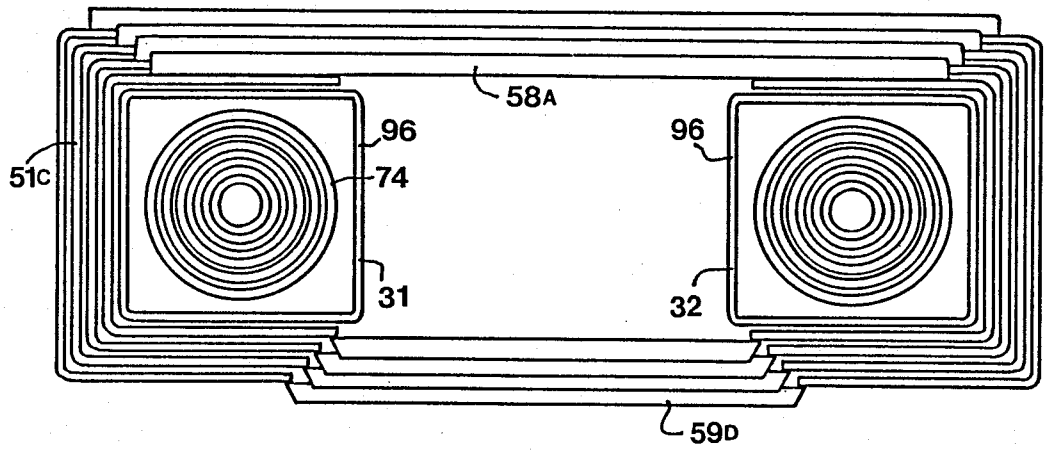

FIG. 2A corresponds to FIG. 2, but shows the mast assembly partly extended;

FIG. 3 is a cross-section of the telescoping hydraulic lift-cylinder assembly included in FIG. 1;

FIG. 4 is a pictorial view of one of the sections of the mast assembly, again shown out of proportion to illustrate the detail;

FIG. 5 is a horizontal cross-section through the mast assembly;

FIG. 6 is a vertical cross-section through the mast assembly.

The mast assembly 10 shown in the drawings has five telescoping sections. The innermost or base section 30 is mounted to the frame 29 of the truck by means of a pivot connection. The driver of the truck can arrange to tilt the mast 10 by operating the hydraulic tilt control cylinder 28, which extends between the frame 29 and the innermost section 30. The innermost section 30 comprises two enclosed square tubes 31,32 joined at the bottom by a floor 36, and at the top by two cross-braces 37,38 and a cap 39.

The lifting forks 40 of the truck are mounted on a carriage 41, which is arranged to move vertically up and down relative to the outermost section 50D of the mast assembly 10. The outermost section 50D is provided with tracks 46, and the carriage 41 is guided in its up/down movement relative to the outermost section by means of the engagement of carriage wheels (not shown) in the tracks 46. Hydraulic cylinders 48 raise the carriage 41 under the direction of the driver. Through a chain drive arrangement 49, the carriage 41 rises at twice the speed of travel of the cylinder rod. It is arranged that, when the driver operates the control to raise the load, the first movement that takes place is the movement of the carriage 41 relative to the outermost section. Only when the carriage is at the top limit of its travel relative to the outermost section do the sections of the mast start to extend.

The four raise-able sections 50A,50B,50C,50D of the mast assembly 10 lie nested upon the innermost section 30. The form and construction of one of the raise-able sections 50 is shown in FIG. 4. The section includes a left channel 51, a right channel 52, a front brace 54, a rear brace 56, a cap 57, a front rail 58, and a rear rail 59.

The two channels 51,52 are formed of a relatively thin gauge of steel, which is simply folded (without heating, and on a brake press, for example) into the channel-shaped form. It is a feature of the invention that the material from which the channesl 51,52 are formed can be thin enough to be formed so easily, and can be so light in weight. In previous designs of mast, the required rigidity could only be gained at the expense of massive thicknesses of steel. The section 50 is stiffened and braced by means of the braces 54,56 and rails 58,59 so that the rigidity and stability of the section 50 arise rather from the inherent rigidity of the section's box-like form, than from the use of massive, heavy channels.

The braces 54,56 and rails 58,59 must be carefully arranged by the designer as to their position on the section 50. The designer must see to it that the braces and rails cannot be so placed as to interfere with the free vertical movement of the section 50B relative to the neighbouring sections, outside 50C, and inside 50A.

The front 54 and rear 56 braces are located right at the top of the channels 51,52 and are joined by the cap 57 of the section.

The front rail 58 is placed almost at the bottom of the front of the channels 51,52. The back rail 59 is placed not at the bottom, but some way up the height of the channels.

This placing of the back rail 59, and the shape of the back rail, are important to the correct functioning of the mast. If the rail were arranged to span the full overall width of the section, then in that case the rail would constitute a travel-stop, since the channels of the adjoining section could not then slide past the back rail.

Such a travel stop function is acceptable in the case of the front rail 58, since the front rail is at the bottom of the section. In fact, the engagement of the channel of one section 50C with the front rail 58 of the neighbouring inside section 50B defines the point at which the sections 50C and 50B are fully closed together.

But the back rail 59 cannot be allowed to function as a travel-stop—because the back rail 59B is not located at the bottom of the section 50B, the channel of section 50C must be able to pass below the back rail 59 of the section 50B. Therefore, it is arranged that the back rail 59 is welded not across the full width of the section, but only to a narrow margin at the edge 60 of the back wall 61 of the channels 51,52. The result is that both the front walls 67 and the back walls 61 of the channels 51,52 are therefore left free over virtually their whole length, which allows the sections to be nested compactly together.

There are several advantages that arise from this arrangement, of positioning of the front rail 58 at the bottom of the channels, and the back rail 59 partway up the height of the channels, to offset the disadvantage that the back rail 59 can only be welded to the channel over a comparatively small contact area. The advantages include:

(a) The section 50 as a whole has a high rigidity-to-weight factor, in all modes in which rigidity is required, including torsion, and including bending, both in the front-to-back plane and in the side-to-side plane, and including buckling under a vertical load.

(b) There is sufficient room underneath the back rails 59 for the tilt-cylinder 28 to pass from the frame 29 of the truck to the floor 36 of the innermost section 30. The tilt cylinder 28 therefore can lie below the axis of the tilt pivot. The tilt cylinder 28 must of course be of the double-acting kind to properly control the tilting of the mast, but when the tilt cylinder lies below the tilt pivot, the main load on the cylinder is a "push" rather than a "pull", and this makes for a smaller cylinder and/or a reduced pressure requirement.

(c) It must be arranged, for safety and stability, that there is still a substantial overlapping engagement between two sections when the appropriate travel limit-stop has been reached. It is convenient to provide the limit-stop 69 directly on the respective rear brace 56. When the limit-stop 69B is so placed, the component of the section 50C that strikes the limit-stop 69B must consequently be partway up the height of the section 50C. The arrangement of the rails as described makes it a simple matter to arrange that the back rail 59C is the component of the section 50C which strikes the limit-stop 69B.

It will be noted that the section 50, though strong and rigid, and stable when extended, is very lightly constructed when compared with other designs of sections of telescoping masts for fork lift trucks.

The section 50 is provided with slipways 70 which are bonded to the channels 51,52 as shown. The section is provided also with appropriately located bearing pads (not shown) which engage the slipways of the adjacent section. The bearing pads should be of the low-friction kind—with the invention, the sections 50 of the mast are so light in weight that a relatively low friction is needed to ensure the sections descend smoothly when in the unloaded condition.

The telescoping hydraulic cylinder assemblies 74 will now be described. There is a respective cylinder assembly 74 in each of the two towers of the mast. One cylinder assembly comprises a concentric arrangement of tubes-within-tubes.

Basically, the cylinder assemblies are made of lengths 76J,76K,76L,76M,76N of plain steel tubing. The seals etc, as required, are mounted in bosses 80,81 which are screwed to the upper and lower ends respectively of the lengths of tubing 76.

By suitable selection of the sizes and type of tubing, special preparation of the tubing for hydraulic use may not be required. The only machining requirement of any substance then is the machining of the bosses 80,81. The tubes themselves would need only to be threaded at their ends, for the purpose of attaching the bosses.

The outermost cylinder 76N is bolted to the floor 36 of the innermost section 30 of the mast 10. The cap 39 of the innermost section 30 has a large hole 85, so that the upper bosses 80 and tubes 76 may telescope upwards through the hole 85.

The cap 57 of each raise-able section 50C is provided with a respective hole 87C of suitable diameter, such that the upper boss 80K of the tube 76K appropriate to that section 50C will engage the rim of the hole 87C, but the upper bosses 80J of the smaller tubes 76J will pass through the hole 87C. The innermost tube 76J of the cylinder assembly 74 operates the outermost section 50D of the mast. Because of this outside-to-inside arrangement of the sections 30,50 and cylinder-tubes 76, each cylinder 76 is able to remain in contact with the cap 57 of its own respective section throughout the telescoping movement of the mast.

As described above, the hydraulic cylinder assembly 74, in the invention, thereby, when extended, takes support against lateral buckling from the mast sections. It is recognised, in the invention, that it is far from economical to try to make the hydraulic tubes buckle-proof in themselves, but it is recognised also that the outside-to-inside arrangement means that there is no need for the hydraulic tubes to be buckle-proof on their own. The telescoping sections of the mast must of course be so designed that when the mast is extended the mast is buckle-proof by a wide margin. This is true whether a mast is arranged to support the cylinder or not. It is recognised, in the invention, that the safety margin by which the mast itself is buckle-proof is such that the mast can easily lend anti-buckling support to the tubes. The invention makes it possible for the inividual tubes 76 to be supported against buckling of the hydraulic cylinder assembly 74, from the individual mast sections 30,50 and thus to take advantage of the much greater anti-buckle capability of the mast. In the invention, the hydraulic cylinder assembly 74 needs no other support against buckling.

The cylinder assembly 74 is supplied with hydraulic fluid through the port 89. The boss 80J of the innermost tube 76J is provided with a port 93, from which the hydraulic fluid is fed to the external cylinders 48 which move the carriage 41 up and down the outermost section 50D. The arrangement is such that pressure cannot develop in the chamber 91, to extend the mast, until the carriage 41 is at the top of its tracks 46 in the outermost section 50D. Similarly, the driver cannot raise any of the individual sections 50 independently of each other.

The result of this constraint is that the mast assembly of the invention provides a foolproof manner of limiting the load which can be raised to a particular height. As the cylinders and sections extend, the larger tubes progressively reach the upper limit of their travel, leaving only the smaller tubes to continue.

The port 89 opens into the hydraulic chamber 91, created inside the outermost tube 76N. The force available for raising the innermost tube 76J out of the next-to-innermost tube 76K (ie the force available for raising the outermost section 50D out of the next-to-outermost section 50C) is determined by the pressure-facing area 90 of the innermost tube 76J. The pressure-facing area 90 of the tubes 76 of course gets progressively smaller, the smaller the diameter of the tube.

The arrangement shown is safe and foolproof. The hydraulic pressure-relief valve setting remains constant throughout the lift. There is no need for the driver to try to estimate how high he can safely raise a particular load. The mast will simply not rise any further, once the load reaches its safe height.

FIG. 1 shows a "rough-terrain" version of a lift truck, which is suitable for lifting materials to roof height on building sites etc. Building sites are notorious as regards the unsafe use of high-lift trucks, because of the debris on the ground, the sometimes-casual supervision, and because no two loads are the same. A foolproof manner of limiting the load to a particular height is therefore particularly appropriate to building-site work. Another particular application for such a foolproof safety limitation is in lift-trucks that operate on the decks of ships at sea. Naturally also, the safety feature is of use in the common (indoor) warehouse or factory lift-trucks.

The innermost or base section 30 of the mast is constructed rather differently from the other sections 50. The innermost section 30 is the section that remains attached to the truck (though it can pivot relative to the truck for tilting the mast) when the other sections 50 rise. The innermost section 30 has the requirement to receive the ram of the tilt cylinder 28 on its floor 36, for which the floor 36 must be strong. The innermost section 30 also has the requirement to support the hydraulic cylinder assemblies 74 on its floor 36, and again the floor 36 has to be strong and rigid to do this.

The cylinder assembly 74 is bolted to the floor 36 by means of a flange 78—the flange 78 is not complete as to its circumference, and the hole 79 in the floor 36 is also correspondingly open to the overall diameter of the flange 78 only over a portion of its circumference, like a keyhole. The cylinder assembly 74 therefore can only pass through the hole 79 at one particular orientation of the flange 78. Once the flange 78 is through the hole 79, the flange 78 is re-orientated, and then bolted to the floor 36 of the innermost section 30. The other sections 50 of course have no floor.

The sections 50 all have a respective cap 57, comprising a plate welded between the front 54 and rear 56 braces. It may be noted that the travel-limit stops 69 are bolted to the rear braces 56, and not welded— this is because the stops 69 have to be removed to allow the mast sections to be separated, when disassembling the mast.

The innermost section 30 is of twin tower construction, each tower comprising an enclosed square tube 31,32. The square tubes are joined by the floor 36 at the bottom, and by the braces 37,38 and cap 39 at the top. This construction is immensely rigid against all modes of possible deflection, as befits the "foundation" section of the mast.

Constructed thus, the inner most section 30 is quite strong and rigid enough to carry the tilt pivot assembly 94, which includes a bearing and a pivot pin. One of these is fixed to the respective inner wall 96 of the enclosed square tubes 30,31. The other is fixed to a support arm 98 which is unitary with the frame 29 of the truck.

The fact that the cylinder assemblies 74 are inside the square towers 31,32 is an advantage since the tubes 76 are thereby protected from damage. It may be thought that this advantage is not really significant, because the carriage-lift cylinders 48 are in any event exposed. The advantage of enclosing the cylinder assemblies 74 is a real one, however, because, although the exposed carriage cylinders 48 are standard propietary items which can easily be replaced if damaged, the cylinder assemblies 74, being special to the truck, if they were to be damaged, could be repaired only with considerable expense and down-time.

In any telescopically-extendable device, the designer must provide travel limit-stops of some kind, to prevent the telescoping sections from coming apart. It will be noted that the travel limit-stops in the invention are provided on the mast sections, and not on the hydraulic cylinders. In the invention, there need be no limit-stops on the tubes themselves, the limit-stops being provided on the mast sections. This is an advantage, because it can be quite expensive to incorporate a robust limit-stop at an intermediate point along the length of a plain steel tube. To enable the hydraulic assembly to be extension-tested separately from the mast, and in case of a mis-use of the mast, the bosses on the hydraulic tubes do act as limit stops to prevent the hydraulic assembly from actually falling apart.

The invention may be applied to telescopic masts generally, not just to the mast assemblies of twin-tower fork lift trucks.

Sometimes, in telescopic masts, it is arranged that the thrust from the hydraulic cyliners, when the mast is fully extended, is so great that the sections of the mast are in tension, the tension being transmitted through the travel limit-stops. (The purpose of this is that such tension increases the resistance of the mast to buckling.) In the conventional arrangement of telescopic masts, where the innermost cylinder operates the innermost section, the weight of the lower sections hangs from the upper sections, so that the tension in the upper sections is greater than the tension in the lower sections. This can be a significant limitation to the permissible tension in the mast if the weight of the mast itself is significant. In the invention, the outside-to-inside arrangement, as described, means that each section's weight is supported on that section's own respective cylinder, and not by the sections above.

We claim:

1. Fork lift truck, having a telescopic mast assembly, characterised in that the truck includes several mast sections, which are arranged one inside the other for telescopic extension;

in that the truck includes a cylinder assembly comprising several fluid-operated lift-cylinder tubes, which are arranged one inside the other for telescopic extension;

in that the truck includes a means for supplying a body of fluid under pressure;

in that the several tubes are exposed together to the said body of pressurised fluid;

in that the number of sections is the same as the number of tubes;

in that the tubes are disposed inside the sections;

in that each of the tubes is in operative engagement with a respective one of the sections;

in that the operative engagement of the innermost tube is with the outermost section;

in that the operative engagement of the next-to-innermost tube is with the next-to-outermost section, and so on in sequence, such that the operative engagement of the outermost tube is with the innermost section.

2. Truck of claim 1, further characterised in that the outermost tube is inside the innermost section.

3. Truck of claim 1, further characterised in that the telescoping mast-sections are constructed each with two vertically disposed towers, spaced apart;

in that the truck includes two of the said cylinder assemblies;

and in that the two assemblies are disposed one to each tower.

4. Truck of claim 3, further characterised in that the mast assembly includes a base section, which is not raise-able with respect to the frame of the truck, and several raise-able sections;

in that the base section is pivotable with respect to the truck;

and in that the base section is the innermost section.

5. Truck of claim 4, further characterised in that the towers of the base section each comprises a respective enclosed tube;

and in that the towers are joined at the bottom by a floor of the section.

6. Fork lift truck, having a telescopic mast assembly, characterised in that the truck includes several mast sections, which are arranged one inside the other for telescopic extension;

in that the truck includes a cylinder assembly comprising several fluid-operated lift-cylinder tubes, which are arranged one inside the other for telescopic extension;

in that the truck includes a means for supplying a body of fluid under pressure;

in that the several tubes are exposed together to the said body of pressurised fluid;

in that the telescoping mast-sections are constructed each with two vertically disposed towers, spaced apart;

in that the truck includes two of the said cylinder assemblies;

in that the two assemblies are disposed one to each tower;

in that the mast assembly includes a base section, which is not raise-able with respect to the truck, and several raise-able sections;

in that the base-section is pivotable with respect to the truck;

in that the base-section is the innermost section;

in that the towers of the base section each comprise a respective enclosed tube;

in that the towers are joined at the bottom by a floor of the section;

in that the assembly includes a means for pivoting the base section, in the form of a hydraulic tilt-cylinder;

in that the hydraulic cylinder acts between a point on the frame of the truck, and a point of the floor of the section.

7. Truck of claim 6, further characterised in that the towers of the raise-able sections each comprise a respective channel-section, the two channel-sections being opened towards each other;

in that the raise-able sections each include a front rail and a rear rail, which extend between the two towers;

in that the front rail is located at the bottom of the section;

and in that the rear rail is located partway up the height of the section.

8. Telescopic mast assembly, characterised in that the assembly includes a number of mast-sections, which are arranged one inside the other for telescopic extension;

in that the assembly includes the same number of fluid-operated lift-cylinder tubes, which are arranged one inside the other for telescopic extension;

in that each of the said tubes is in operative engagement with a respective one of the mast-sections;

in that the operative engagement of the innermost tube is with the outermost section;

in that the operative engagement of the next-to-innermost tube is with the next-to-outermost section and so on in sequence, such that the operative engagment of the outermost tube is with the innermost section.

* * * * *